US005158471A

United States Patent [19]

Fedder et al.

[11] Patent Number: 5,158,471

[45] Date of Patent: Oct. 27, 1992

[54] POWER CONNECTOR WITH CURRENT DISTRIBUTION

[75] Inventors: James L. Fedder, Etters; Lee A. Barkus, Millersburg; Matthew M. Sucheski, Harrisburg, all of Pa.

[73] Assignee: AMP Incorporated, Harrisburg, Pa.

[21] Appl. No.: 806,946

[22] Filed: Dec. 11, 1991

[51] Int. Cl.[5] ..... H01R 9/09

[52] U.S. Cl. ..... 439/80; 439/65; 439/79

[58] Field of Search ..... 439/78-81, 439/108, 65

[56] References Cited

U.S. PATENT DOCUMENTS

| | | | |
|---|---|---|---|
| 4,077,694 | 3/1978 | Cobaugh et al. | 339/176 |
| 4,241,381 | 12/1980 | Cobaugh et al. | 361/413 |
| 4,755,145 | 7/1988 | Johnson et al. | 439/61 |
| 4,790,764 | 12/1988 | Kawaguchi et al. | 439/78 |

*Primary Examiner*—Eugene F. Desmond

[57] ABSTRACT

A power connector for interconnecting power between printed circuit boards (12, 24) includes plug and receptacle contacts (40, 70) linked to signal connector halves (16, 28) alos mounted on the circuit boards such that the plug and receptacle contacts intermate along a given axis as the connector halves are intermated. The receptacle contact (70) includes an array of resilient contact fingers (80-82) spaced apart and staggered to engage the plug contact (40) upon mating along the given axis at given points to reduce insertion forces, preclude undue wear of the plug contact from repeated engagements while carrying sufficient current to effect a power transfer from one board to another board. The contacts further include a plurality of posts (48, 74, 76) spaced apart to distribute current to the thin conductive traces of boards to preclude undue resistance heating of such traces in the circuits defined thereby. Insulating housings (52, 56) of the plug and receptacle contacts are provided with the housing (56) surrounding the receptacle contact to preclude accidental shorting as between multiple contacts.

10 Claims, 3 Drawing Sheets

POWER CONNECTOR WITH CURRENT DISTRIBUTION

This invention relates to a power connector for interconnecting power between circuit boards or the like.

BACKGROUND OF THE INVENTION

The ever increasing density of components used in electronic packaging, such as those used for computers and the like, wrought by the development of integrated circuits, has created the need for power connectors to carry the power required by densely spaced logic and memory components. U.S. Pat. No. 4,755,145, teaches an electrically connecting circuit board system featuring bus bars on the upper surface of a backplane board which are engaged by fork-like contacts mounted on a daughter board. In this way, power is supplied to a daughter board to supply components on such board with power. The bus bars utilized in the patented system are open with the mating fork-like contacts shrouded in a housing. Multiple bus bars are positioned side by side on the backplane board to carry different power levels in terms of voltage and current and the bus bars are made relatively heavy in terms of current capacity. As compared with the solid bus bars of the system, the individual contacts on the daughter board are relatively small and fragile.

It is an object to provide a power connector for interconnecting the power required by circuit boards and the like through a connector without an exposed bus bar on the surface of a backplane board by using a connector insulated with respect to such backplane board.

It is still a further object to provide a power connector that operates to distribute substantial current levels through multiple contact points to circuits such as printed circuit boards to minimize resistance heating caused by high level current with respect to the thin foil power and ground paths in or on circuits such as those used with printed circuit boards.

SUMMARY OF THE INVENTION

The present invention includes a power connector comprised of mating plug and receptacle contacts, each including a series of relatively small posts adapted to fit within and be joined to the thin conductive trace formed by additive or subtractive processes on circuit boards including backplanes, mother boards, and daughter boards. Each of the contacts has a common, heavy, current-carrying portion joined to the post portions adapted to handle currents in the tens of amperes range. The plug contact includes a blade joining a plurality of posts that are on centers to fit with a daughter board and further includes a housing that links the plug contact mechanically to a signal connector also mounted on a daughter board. The receptacle contact includes a plurality of spring fingers which engage the plug contact upon insertion of the plug into the receptacle in a manner allowing repeated engagement and disengagement of the plug within the receptacle, with minimum wear of the contact traces on the plug caused by the fingers of the receptacle. This is accomplished by staggering the fingers so that they engage the surface of the plug at different points with respect to the axis of the insertion of the plug within the receptacle. The receptacle further includes a plurality of posts which are of a size and one centers to mate with holes and be terminated to conductive traces on or within a mother board. The receptacle is "probe-proof" meaning that an operator assembling or disassembling boards cannot touch the circuits of the receptacle half and further, that extraneous conductive material cannot short out the power circuits by falling across an exposed bus bar or across exposed contacts on the mother board.

The invention contemplates uses of the power contact in multiples to carry power and/or ground circuits to mother and daughter board circuits, of different current levels and/or different voltage levels as required by the components carried on a daughter board.

DETAILED DESCRIPTION OF THE DRAWINGS

Figure 1:
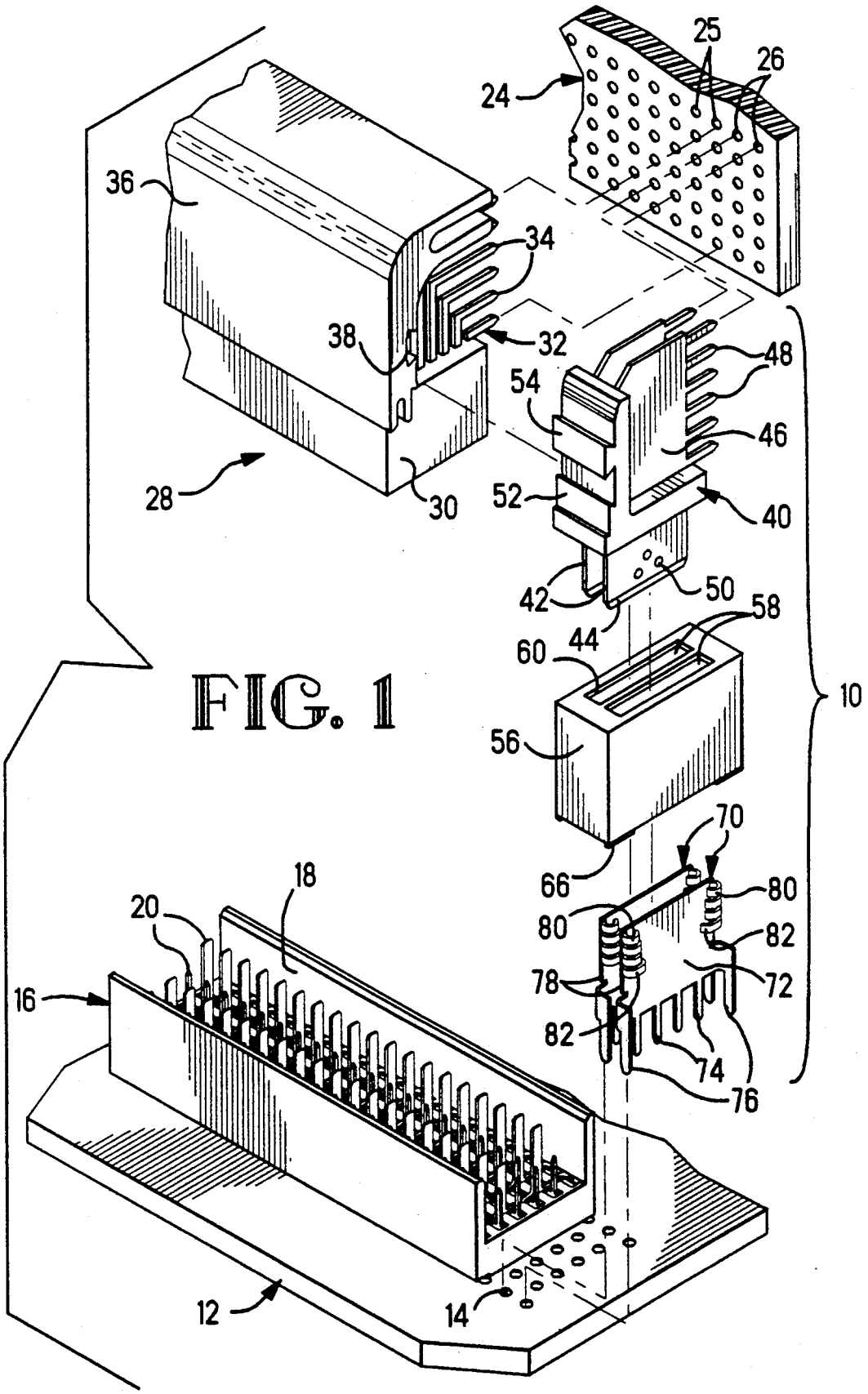
FIG. 1 is a perspective view showing the various elements of an assembly including portions of mother and daughter boards and the power connector of the invention, exploded therefrom and prior to assembly.

Referring now to FIG. 1, an assembly 10 includes a backplane or mother board 12 is shown in relation to a daughter board 24. In practice, board 12 is interconnected to multiple boards 24 that carry a variety of components and operate together through circuits in the boards to provide an overall system function such as for a computer, communication equipment and the like. Each of the boards 12 and 24 includes a series of circuits of conductive traces formed by etching away thin copper foil or electroplating onto sheets of insulating and dielectric material with layers of such sheets being bonded together to form circuits distributed on the surfaces of the boards or within the boards. These circuits include signal pathways that extend between components and, additionally, circuits that carry power and ground connections to the various components. Access to these circuits is provided through holes, such as 14 in board 12, and 25 and 26 in board 24. These holes are typically made conductive through plating of conductive material therein and are adapted to receive posts or pins inserted therein which can be interconnected to the plating and thus to the circuits within the boards. In FIG. 1, the holes 14 and 26 are used for power and ground connections to power and ground circuits within or on the board, and the holes such as 25, with respect to board 24, and holes not shown on board 12 are employed for the signal circuits of the assembly 10. In FIG. 1, a signal connector 16 includes a housing 18, typically of plastic and insulating material, containing arrays of contacts 20 that provide signal interconnections. In using the term signal interconnections, it is recognized that certain of the contacts 20 typically include ground and signal levels that form part of the signal transmission used by the system. This is to be distinguished from the power utilized to power components which manipulate, store, and treat such signals.

A complementary mating connector 28 is shown positioned above connector 16 and includes mating contacts 32, the mating ends not being shown, adapted to engage the contacts 20. The connector 28 includes a housing 30 of dielectric and insulating material carrying the arrays of contacts 32 that extend through right angle bends to define arrays of posts 34 on centers to fit within the holes 25 of board 24. The connector 28 further includes a surrounding, conductive stiffener 36 that serves to add mechanical rigidity to connector 28 and shield the signal paths of the contacts 32. To be noted in FIG. 1 is the dove-tailed relief 38 that operates in conjunction with an extending portion of stiffener 36 to receive, align and position a power plug contact 40.

Figure 3:
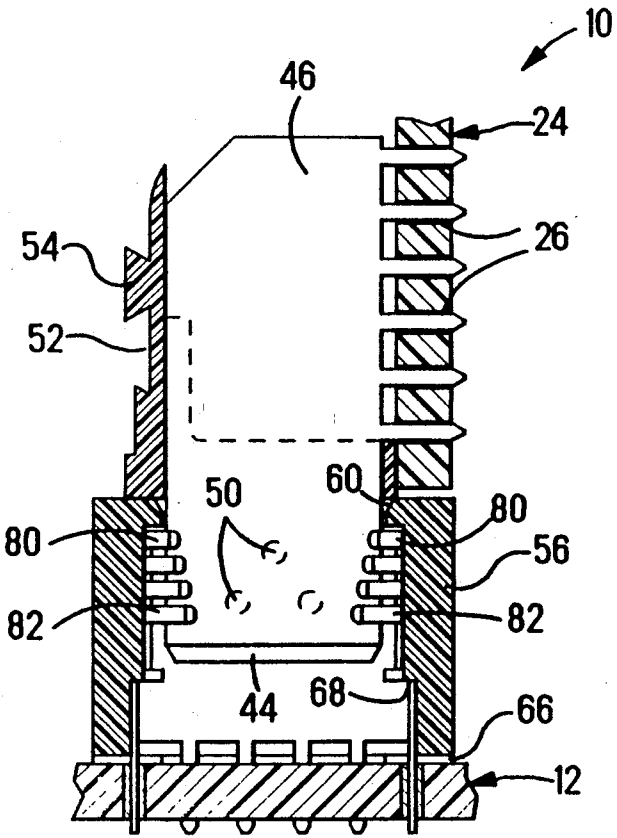
FIG. 3 is a view similar to FIG. 2 with the power connector mated.
Figure 2:
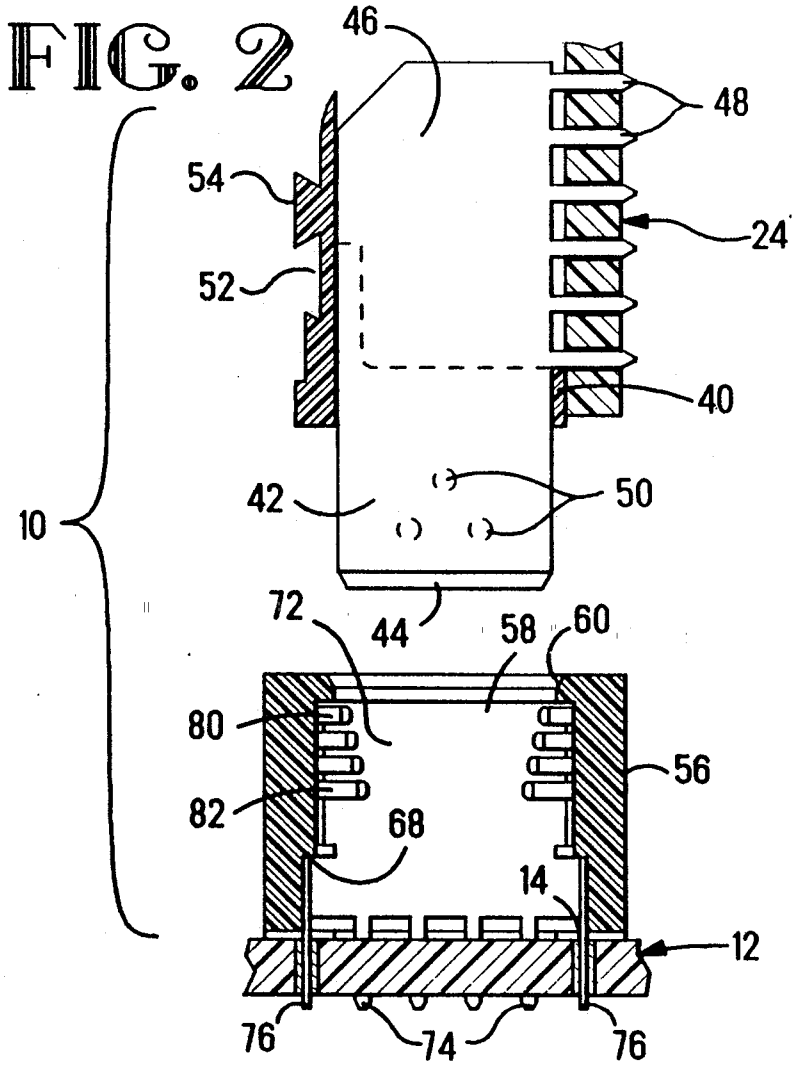
FIG. 2 is a side, elevational, and partially sectioned view of the power connector of FIG. 1 terminated to printed circuit boards, aligned for, but prior to, mating.

The power plug contact 40 includes a pair of contact blades 42 beveled at 44 for entry into a mating receptacle 70, and extending rearwardly of the blade 42 a flat portion 46 having an array of posts 48 along one side. The posts 48 are of a dimension and on centers to fit within holes 26 of board 24 and join circuits of such board to the common conductive plate portion 46. Current flowing in the plug contact blade 42 will thus be distributed to the posts 48 and to the relatively fine conductive traces of board 24. Blades 42 further includes a series of bumps or projections 50, as shown in FIGS. 1, 2, and 3 that operate in cooperation with the receptacle to assure good, low-resistance interface with the receptacle. Plug contact 40 includes an insulating housing 52 that is utilized to join blades 42 and link such blades to the signal connector 28 through a dove tail surface 54 that fits within the surface 38, allowing the plug contact 40 to be positioned just adjacent to and aligned with connector 28. To be noted is the recessed relationship of housing 30 with respect to the stiffener 36 and the end thereof facilitating the mounting of the plug contact 40 in a manner tied to the signal connector 28.

Figure 4:
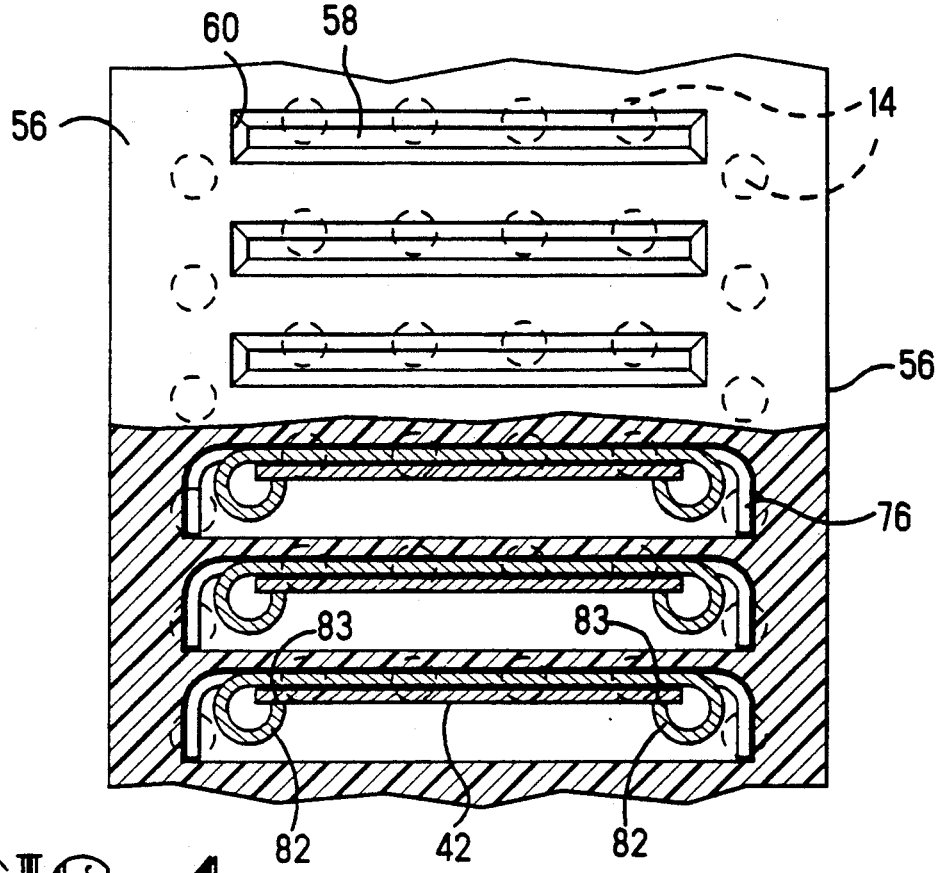
FIG. 4 is a plan view showing in partial section a number of power receptacles having the plugs inserted therein in a form intended to accommodate a plurality of receptacles.
Figure 5:
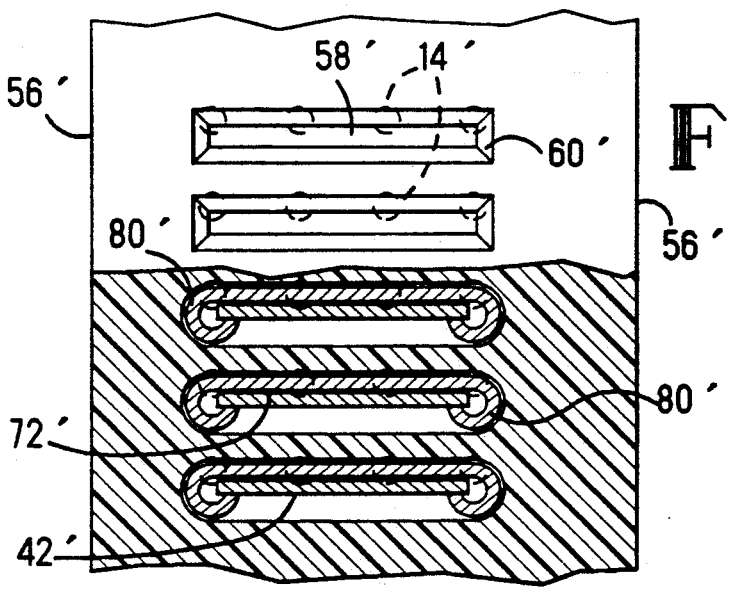
FIG. 5 is a view of an alternative power connector showing the plug and receptacles in section.

In FIG. 1, shown beneath the plug contact 40, is a housing 56 of insulating and dielectric material which includes a pair of apertures 58, beveled at 60, leading through the housing as also shown in FIGS. 2 and 3. Housing 56 includes feet 66 which provide an offset from the upper surface of board 12. In FIGS. 2 and 3, the housing 56 may be seen to include an interior ledge in the form of a surface 68 that engages a portion of a receptacle contact 70. The receptacle contact 70 includes a plate portion 72 and a plurality of posts 74 extending downwardly from such portion of a size and on centers to fit within the holes 14 of board 12 and to join the circuits in or on such board. Additionally, extending downwardly are further posts 76 which also fit within the holes 14 and join circuits therein. The posts 76 are formed at right angles to portion 72 to define surfaces engaging the board, adding stability to the mounting of receptacle contact 70 in the board. Receptacle contact 70 includes extending from the edges 78, a plurality of contact fingers 80–82 that are rounded in the manner indicated in FIG. 1 and particularly in FIGS. 4 and 5. The contact fingers 80, 82 represent the leading and trailing contact fingers on each side of portion 72. As can be seen in FIGS. 2 and 3, contact fingers 80 are the shortest with the contact fingers 82 being the longest of the sets of four that are provided on receptacle contact 70. As can be seen in FIGS. 4 and 5, the fingers 82 curl around in a circular fashion to define contact points 83 which engage the edge surfaces of the blade 42 of the plug contact 40.

As can be appreciated from FIGS. 2 and 3, the plug contact 40 is engaged with the receptacle contact 70, progressively with the blade 44 entering through the bevel edge 60 of housing 56 down into the interior recess 58 with the bevel 44 assisting in such insertion as is required. As blade 42 enters into the receptacle, the bumps 50 engage the portion 72 of contact 70 and operate in conjunction with the thickness of blade 42 to cause the upper surface of the blade to engage the fingers 80–82 and drive such fingers resiliently upward to define points of contact having a normal force sufficient to develop a low resistance, stable electrical interface. As can be appreciated from FIGS. 2 and 3, the fingers 80–82, four in number on each side of the contact in the illustrative embodiment, are of different lengths to position the contact points in a staggered manner so that the tracks of engagement of the ends of the spring fingers are not aligned. This assures two advantageous results with respect to the power contact of the invention. First, the engagement of the fingers is progressive so that the ramp or entry force of the blade 42 into the receptacle contact 70 is only that of a pair of fingers; fingers 80 first engaging contact 42 followed by the next set of fingers, and then the next, and finally the fingers 82 engaging the contact 42 last as it is inserted. Once the contact 42 is in engagement with the given spring finger, the force resulting is a sliding frictional force and not a ramp force to thus reduce the overall engagement or ramp force of mating of the contacts. A second advantage is that the ends of the spring fingers do not run in a common track with respect to the blade 42, the staggering providing separate and independent tracks to minimize wear to that of a single, relatively small spring finger rather than a large spring finger, reducing wear both by the size of the spring finger and the fact that the fingers have different tracks. The use of multiple fingers additionally distributes current flow in the contact 70.

FIG. 4 represents a version of the receptacle connector of the invention showing some six positions for receptacle contact 70. The sectioning to the top of the view shows the disposition of the cavity 58 in the lower part of a housing 56 with respect to the various holes 14 in board 12, shown in phantom, and the lower part of the Figure shows the relationship of the engagement between blade and receptacle and contact fingers. FIG. 4 also shows the bevel 60 which facilitates insertions of plug contacts by guiding such contacts through an engagement with the bevel 44 thereon into the housing 56 and into the receptacles 70. To be appreciated particularly from FIGS. 1, 3, and 4, is the fact that the receptacle contact is covered by insulation with a very narrow entry when in the unplugged condition and no entry in the plugged condition to protect the several receptacle contacts from being shorted out or accidentally engaged.

FIG. 5 shows an alternative version of the housing 56' including features similar to those heretofore described but with the receptacle contact 70' reduced in width along with the housing apertures 58', bevels 60' in relationship to holes 14' of board 12. Thus, the contacts of FIG. 5 include only four posts rather than the six shown in the embodiment with respect to FIG. 4. It is to be understood that the invention contemplates the use of blade and receptacle contacts having either fewer or greater numbers of posts than illustrated with appropriate dimensional changes to the housings. From FIGS. 4 and 5, it should be appreciated that the invention contemplates uses of the power connector of the invention singly or in multiples with different power connectors utilized for different current circuits or different voltages to include carrying not only power but ground circuits through the boards.

It is contemplated that the power contacts in the invention should be made of high conductivity material, typically a copper alloy, with the receptacle contact having spring characteristics so as to develop adequate normal forces of engagement through the elastic deformation of the fingers 80–82 in engagement with the edges of the blade. The invention also contemplates that the advantages herein taught may be achieved through different arrangements of one or more rows of spring fingers defining the receptacle, the positioning of such fingers operating to minimize ramp forces during insertion and to provide redundancy of contact with minimum wear to the blade portion of the power contact. The use of the term board is intended to include both rigid and flexible circuits utilized for packaging.

Having now described the invention relative to drawings intended to depict preferred embodiments, claims are appended intended to define what is inventive.

We claim:

1. An electrical connector for interconnecting power between two circuits of circuit boards including a pair of contacts, each having a body of sufficient conductivity to carry a given current and each including a plurality of spaced apart posts, each of lesser conductivity, positioned to connect to the conductive traces of the circuit boards to distribute the given current over a region of the traces to preclude undue heating of the traces and the connector, one of the pair of contacts including a blade portion of a given length and width and the other contact having a receptacle portion including sets of contact spring fingers with the ends of the fingers positioned to engage the blade portion at different points on said blade portion upon insertion of the blade portion into the receptacle portion and with the ends of the fingers positioned to follow different tracks along said blade portion to reduce insertion force of the blade into the receptacle and minimize wear while providing multiple contact points sufficient to carry the given current without undue heating caused by resistance.

2. The connector of claim 1 wherein the said fingers extend from each edge of the receptacle portion relative to the width of said blade portion along a portion of the length thereof.

3. The connector of claim 1 wherein said receptacle portion includes a base portion having the fingers extending thereover to define contact points spaced from the base portion a distance less than the thickness of said blade portion so as to cause said fingers to be deflected upon insertion of the blade portion along the receptacle portion.

4. The connector of claim 1 including a plastic and insulating housing having at least one recess with the housing fitted over the receptacle portion within such recess and further including an aperture adapted to receive said blade portion inserted through said housing into the receptacle portion.

5. The connector of claim 4 wherein the said housing includes a plurality of recesses and the connector includes a plurality of receptacle contacts mounted in such receptacle in side-by-side relationship.

6. The connector of claim 1 for use with signal connectors mounted on said boards and further including a housing for said one contact and surfaces on such housing adapted to engage the signal connector and mechanically link the power connector to said signal connector as mounted on said board.

7. The connector of claim 1 for use with circuit boards having arrays of holes on given centers used for signal connectors wherein said contacts including said posts are arranged on such centers.

8. An electrical connector for interconnecting power circuits including plug and receptacle contacts stamped and formed of conductive sheet material with at least said receptacle contact being formed of spring grade material to include a flat base having a length extending along the axis of insertion of the plug contact into the receptacle and having sides extending along said length with a plurality of spring fingers extending out from the sides of the said base and curving back toward the said base with the ends of the said fingers spaced from the base by a distance less than the thickness of the plug contact inserted therein, said fingers each being of a different length along a given side of the contact to engage the plug contact at a different point relative to the width of said receptacle and plug contacts and with said fingers spaced apart along the length of the receptacle contact to engage the plug contact sequentially upon insertion of the plug contact within the receptacle contact in order to reduce the insertion force of the plug contact into the receptacle contact and minimize wear caused by the fingers in engagement.

9. The connector of claim 8 wherein said plug and receptacle contacts each include an array of posts integrally formed therewith and extending outwardly therefrom to engage the holes in circuit boards and interconnect to the circuits thereof.

10. The connector of claim 9 wherein said plug and receptacle contacts have a given cross-sectional area to carry a given current and said posts have a cross-sectional area a fraction of said given area to carry a lesser current to distribute the given current through the several posts and minimize current levels in the power circuits.

* * * * *

UNITED STATES PATENT AND TRADEMARK OFFICE

CERTIFICATE OF CORRECTION

PATENT NO. : 5,158,471

DATED : OCTOBER 27, 1992

INVENTOR(S) : Lee A. Barkus et al.

It is certified that error appears in the above-identified patent and that said Letters Patent is hereby corrected as shown below:

In the Abstract:

Abstract, Line 4 - The word "alos" should be --also--.

Signed and Sealed this

Twelfth Day of October, 1993

*Attest:*

Bruce Lehman

BRUCE LEHMAN

*Attesting Officer*

*Commissioner of Patents and Trademarks*